US008240658B2

(12) United States Patent
Ushiyama

(10) Patent No.: US 8,240,658 B2
(45) Date of Patent: Aug. 14, 2012

(54) IMAGE FORMING APPARATUS

(75) Inventor: Yousuke Ushiyama, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/034,430

(22) Filed: Feb. 24, 2011

(65) Prior Publication Data

US 2011/0215518 A1 Sep. 8, 2011

Related U.S. Application Data

(60) Provisional application No. 61/310,169, filed on Mar. 3, 2010.

(51) Int. Cl.
*B65H 1/06* (2006.01)

(52) U.S. Cl. ..... 271/164; 271/145; 399/16

(58) Field of Classification Search ..... 271/9.11, 271/145, 162, 164, 4.02; 399/16, 21, 23, 399/393

See application file for complete search history.

(56) References Cited

U.S. PATENT DOCUMENTS

| | | | | |
|---|---|---|---|---|
| 5,923,140 | A * | 7/1999 | Azumi et al. | 318/640 |
| 6,409,165 | B1 * | 6/2002 | Yamaoka et al. | 271/145 |
| 7,690,647 | B2 * | 4/2010 | McNamara et al. | 271/207 |
| 7,717,421 | B2 * | 5/2010 | Rennick et al. | 271/207 |
| 8,023,837 | B2 * | 9/2011 | Nishitani et al. | 399/18 |
| 8,042,801 | B2 * | 10/2011 | You | 271/157 |

* cited by examiner

*Primary Examiner* — Jeremy R Severson
(74) *Attorney, Agent, or Firm* — Patterson & Sheridan, LLP

(57) ABSTRACT

According to one embodiment, an image forming apparatus includes a cassette, a sensor and a controller. The cassette stacks a sheet. The sensor is provided at the rear end of the cassette. When the sensor detects the protrusion of the sheet from the cassette, the controller controls to notify that the sheet protrudes by using an alarm.

20 Claims, 7 Drawing Sheets

IMAGE FORMING APPARATUS

CROSS-REFERENCE TO RELATED APPLICATIONS

This application is based upon and claims the benefit of priority from Provisional Application No. 61/310,169, filed on Mar. 3, 2010, the entire contents of which are incorporated herein by reference.

FIELD

Embodiments described herein relate generally to an image forming apparatus in which sheet remaining at the time of pulling out a sheet cassette is prevented.

BACKGROUND

At present, in a sheet cassette inserted in an image forming apparatus, a structure including a tray for stacking a sheet bundle and a pair of side walls to regulate the position of the sheet bundle in the width direction is mainstream. The sheet cassette further includes a coupling member (shaft+pin). When the sheet cassette is inserted in the inside of the image forming apparatus, the coupling member is inserted in a drive unit (coupling) fixed in the image forming apparatus and is coupled. The drive unit raises the tray to a position where the uppermost sheet of the sheet bundle stacked on the tray contacts a paper feed roller.

On the other hand, when the sheet cassette is pulled out from the inside of the image forming apparatus, there is a possibility that the uppermost sheet of the sheet bundle is placed in the state in which the sheet contacts the paper feed roller or is pinched. In this case, a friction force is exerted on the uppermost sheet by the paper feed roller. While the sheet cassette is pulled out from the inside of the image forming apparatus, the uppermost sheet is forced to remain in the inside of the image forming apparatus. There is a possibility that the uppermost sheet climbs over the side wall, and drops into a portion in the inside of the image forming apparatus and between the sheet cassette and the drive unit. Here, the portion in the inside of the image forming apparatus and between the sheet cassette and the drive unit is defined as a rear side space of the sheet cassette. Even if the uppermost sheet does not contact the paper feed roller, there is a possibility that the sheet drops into the rear side space of the sheet cassette by the shock when the sheet cassette is inserted into the inside of the image forming apparatus. This phenomenon is liable to occur when a maximum number of sheets are stacked on the sheet cassette.

When the sheet cassette is inserted into the inside of the image forming apparatus in the state where the sheet drops in the rear side space of the image forming apparatus, there is a possibility that various defects occur in the image forming apparatus. The sheet dropped in the rear side space of the sheet cassette cuts off the coupling between the coupling member and the drive unit, or damages these parts.

Although the defects as stated above exist, the user can not recognize that the sheet is significantly shifted from a normal set position in the sheet cassette, and further, the user can not recognize even that the sheet drops in the rear side space of the sheet cassette.

DETAILED DESCRIPTION

In general, according to one embodiment, an image forming apparatus includes a cassette, a sensor and a controller. The cassette stacks a sheet. The sensor is provided at the rear end of the cassette. When the sensor detects the protrusion of the sheet from the cassette, the controller controls to notify that the sheet protrudes by using an alarm.

Figure 1:
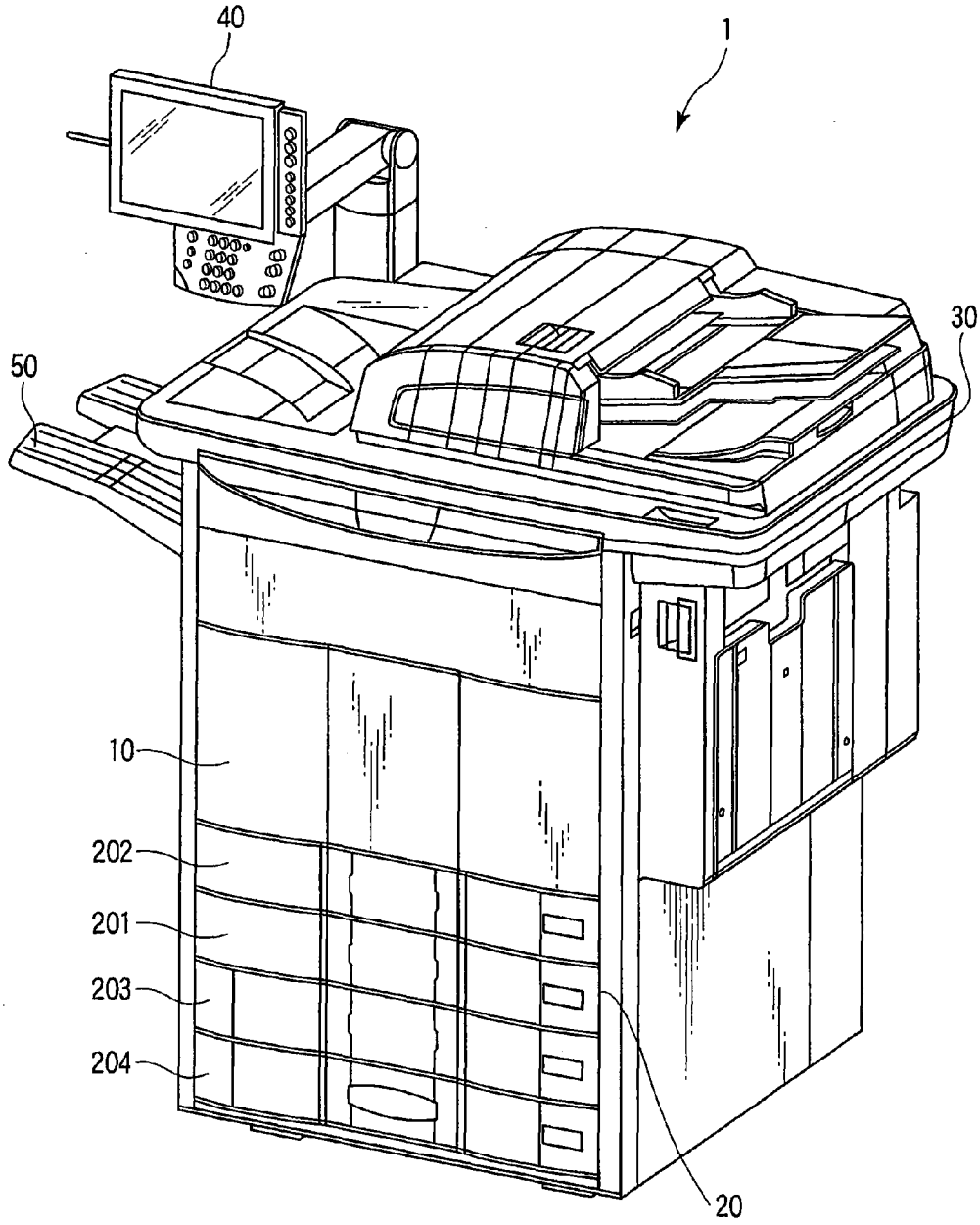
FIG. 1 is an exemplary schematic view showing an outer appearance of an image forming apparatus of an embodiment.

FIG. 1 is a perspective view showing the outer appearance of an image forming apparatus 1 of an embodiment. The image forming apparatus 1 includes an image forming part 10, a sheet conveyance device 20, a scanner 30, a control panel 40 and a paper discharge tray 50. The image forming part 10 is located at the center of the image forming apparatus 1. The image forming part 10 outputs image information as an output image called, for example, a hardcopy or a printout. The sheet conveyance device 20 is located below the image forming part 10. The sheet conveyance device 20 supplies a sheet of an arbitrary size used for image output to the image forming part 10. The sheet conveyance device 20 has a space for receiving a sheet cassette 201, a sheet cassette 202, a sheet cassette 203 and a sheet cassette 204. The sheet conveyance device 20 contains the sheet cassette 204, the sheet cassette 203, the sheet cassette 201 and the sheet cassette 202 in this order from below in the vertical direction while they face each other. An upper part of the sheet cassette 202 in the vertical direction is the bottom of the image forming part 10.

The scanner 30 is located at an upper part of the image forming apparatus 1. The scanner 30 captures image information, which is an object of image formation in the image forming part 10, from a document as image data. The control panel 40 is located at an upper part of the image forming apparatus 1. The control panel 40 has an input function to input the start of image formation in the image forming part 10 and the start of reading of image information of a document by the scanner 30. The control panel 40 has a display function to display various messages to the user. The paper discharge tray 50 is located at the side of the image forming apparatus 1. The paper discharge tray 50 stacks the sheet subjected to the image formation by the image forming part 10.

Figure 2:
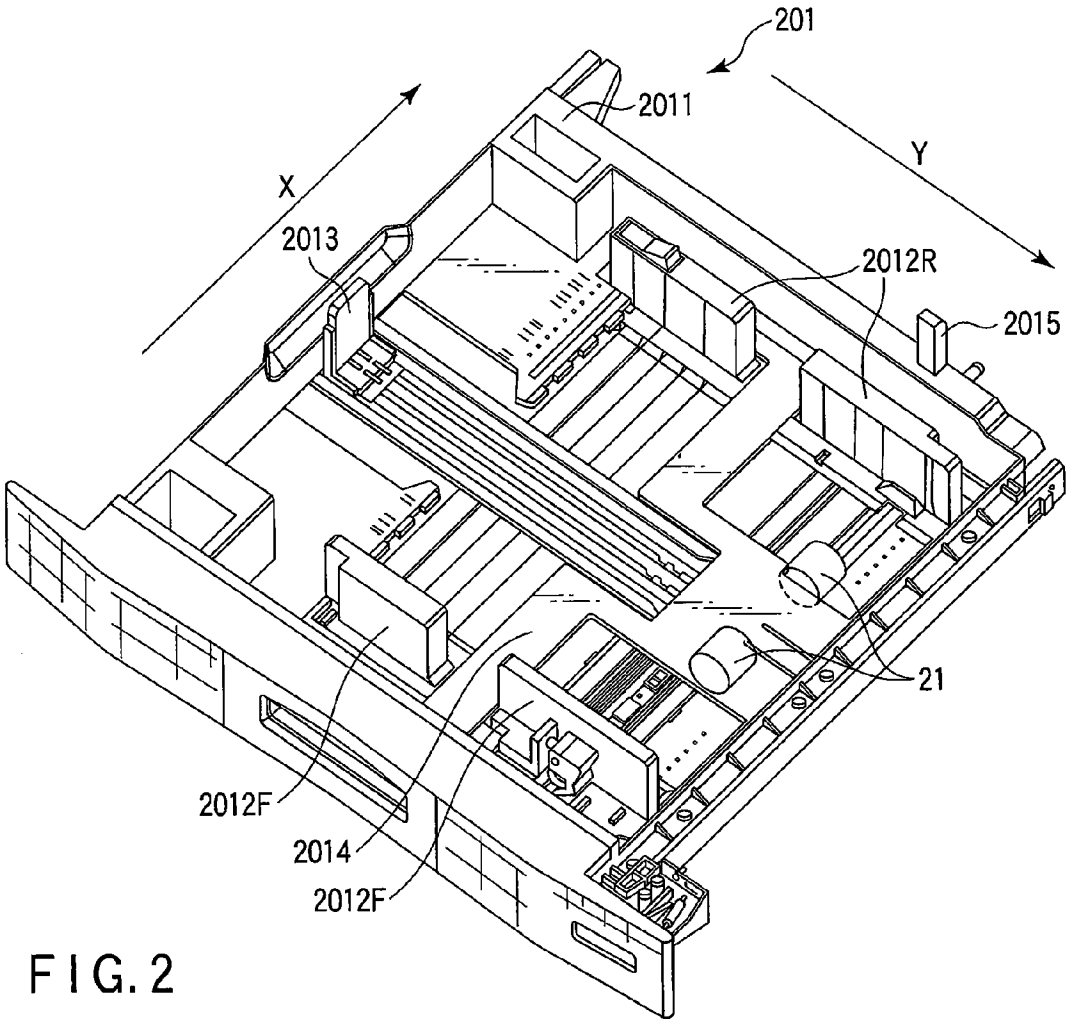
FIG. 2 is an exemplary upper perspective view of a sheet cassette of the embodiment.

FIG. 2 is an upper perspective view of the sheet cassette 201 which is detached from and attached to the sheet conveyance device 20 of the embodiment. Here, although the structure of the sheet cassette 201 will be described, the structures of the sheet cassettes 202, 203 and 204 are the same. An arrow X indicates an insertion direction (hereinafter referred to as an insertion direction of the sheet cassette 201) of the sheet cassette 201 to the sheet conveyance device 20. Besides, the opposite direction to the arrow X is a direction of pulling out the sheet cassette 201. In this embodiment, in the state where the sheet cassette 201 is mounted in the sheet conveyance device 20, the side of the sheet cassette 201 positioned in the inside of the sheet conveyance device 20 is defined as a rear side, and the side positioned at the outside of the sheet conveyance device 20 is defined as a front side. The image forming apparatus 1 includes a paper feed roller 21. When the sheet cassette 201 is mounted, the paper feed roller 21 faces the upper surface of a sheet bundle stacked on the sheet cassette 201. The paper feed roller 21 conveys the sheet one by one from the upper surface of the sheet bundle stacked on the sheet cassette 201 to the image forming part 10. The paper feed roller 21 conveys the sheet in a Y direction orthogonal to the X direction in which the sheet cassette 201 is mounted in the sheet conveyance device 20. The paper feed roller 21 faces the leading edge side of the sheet in the Y direction.

The sheet cassette 201 includes a housing 2011, a front-side side wall 2012F, a rear-side side wall 2012R, an end wall 2013, a tray 2014 and a sensor 2015. The housing 2011 is box-shaped, and sheets are stacked and received in the inside thereof. In the housing 2011, the sheet bundle is stacked so that the X direction coincides with the width direction of the sheet, and the Y direction coincides with the longitudinal direction of the sheet. The front-side side wall 2012F contacts the side surface, at one end side (front side), of the sheet bundle stacked on the sheet cassette 201. The front-side side wall 2012F moves back and forth in the X direction, and regulates the position of the sheet in the width direction. Similarly, the rear-side side wall 2012R contacts the side surface, at the other end (rear side), of the sheet bundle stacked on the sheet cassette 201. The rear-side side wall 2012R moves back and forth in the X direction, and regulates the position of the sheet in the width direction.

The end wall 2013 contacts the surface, at the rear end side, of the sheet bundle in the Y direction. The end wall 2013 moves back and forth in the Y direction, and regulates the position of the sheet in the longitudinal direction. The tray 2014 contacts the lowermost surface of the sheet bundle stacked on the housing 2011.

Incidentally, in this embodiment, sheet displacement means that the sheet climbs over the rear side wall surface of the sheet cassette 201 and is displaced to a position where the sheet contacts the sensor 2015. Sheet remaining means that the sheet subjected to the sheet displacement drops in the rear side space of the sheet cassette 201, and remains in the inside of the image forming apparatus 1.

The sensor 2015 is positioned in the vicinity of the wall surface of the sheet cassette 201 at the rear side. The sensor 2015 protrudes in the vertical direction from the housing 2011. The sensor 2015 is a rod-shaped actuator. The sensor 2015 detects a change of pressure due to the contact of something with a portion protruding in the vertical direction from the housing 2011. While the sensor 2015 detects that some pressure is applied, the sensor is placed in the ON state and outputs a signal. That is, the sensor 2015 can detect the sheet displacement. Specifically, the sensor 2015 detects the sheet which climbs over the rear-side side wall 2012R in the X direction, and further climbs over the rear side wall surface of the sheet cassette 201 (protruding from the housing 2011). While nothing contacts the portion protruding from the housing 2011 in the vertical direction, that is, no pressure is applied, the sensor 2015 is placed in the OFF state and does not output a signal. When the sheet cassette 201 is pulled out from the image forming apparatus 1, the sensor 2015 pulls out the sheet subjected to the sheet displacement, together with the sheet cassette 201, from the inside of the image forming apparatus 1. The sensor 2015 functions also as a stopper to prevent the sheet from remaining in the image forming apparatus 1.

Figure 3:
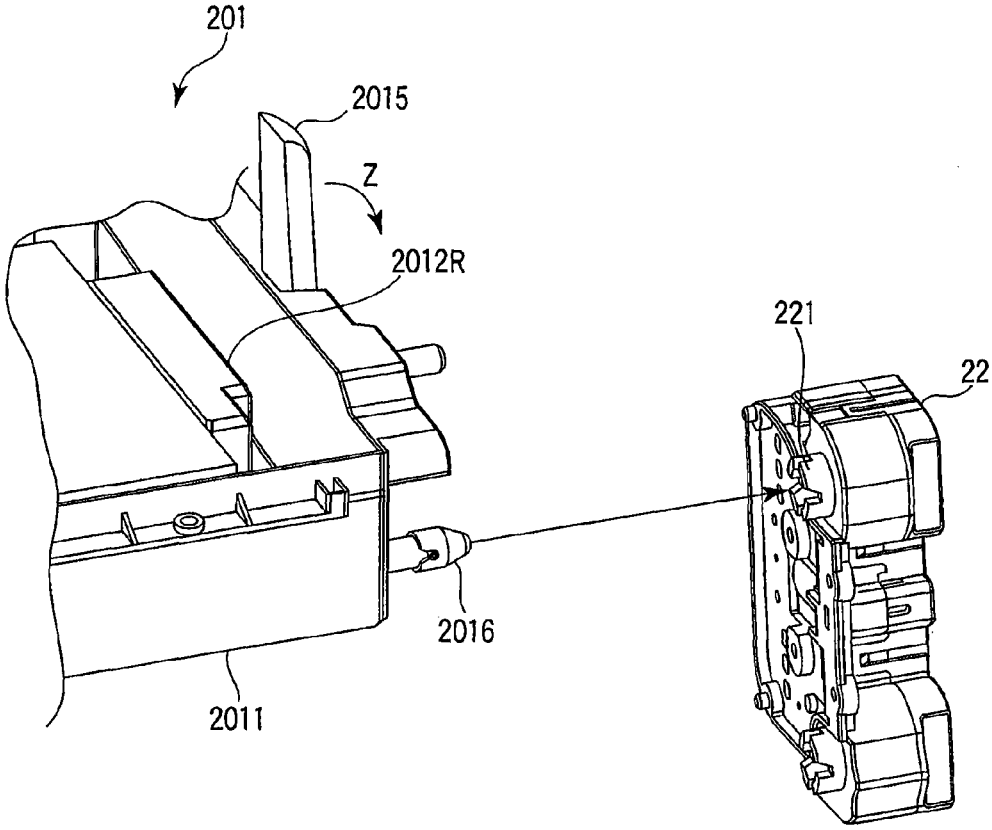
FIG. 3 is an exemplary upper perspective view of the sheet cassette and a drive unit of the embodiment.

FIG. 3 is a perspective view of the sheet cassette 201 of the embodiment at the rear side. The sheet cassette 201 further includes a coupling member 2016. The coupling member 2016 is a member protruding from the rear side wall surface of the sheet cassette 201 in the X direction. When the sheet cassette 201 is inserted in the image forming apparatus, the coupling member 2016 is coupled to a drive unit 22 fixed to the image forming apparatus 1. The drive unit 22 includes a coupling member 221 coupled to the coupling member 2016. The drive unit 22 drives the tray 2014 through the coupling member 2016. The tray 2014 pushes up the whole sheet bundle from the bottom of the housing 2011 to the paper feed roller 21 in order to ensure conveyance of the sheet by the paper feed roller 21.

Figure 4A:
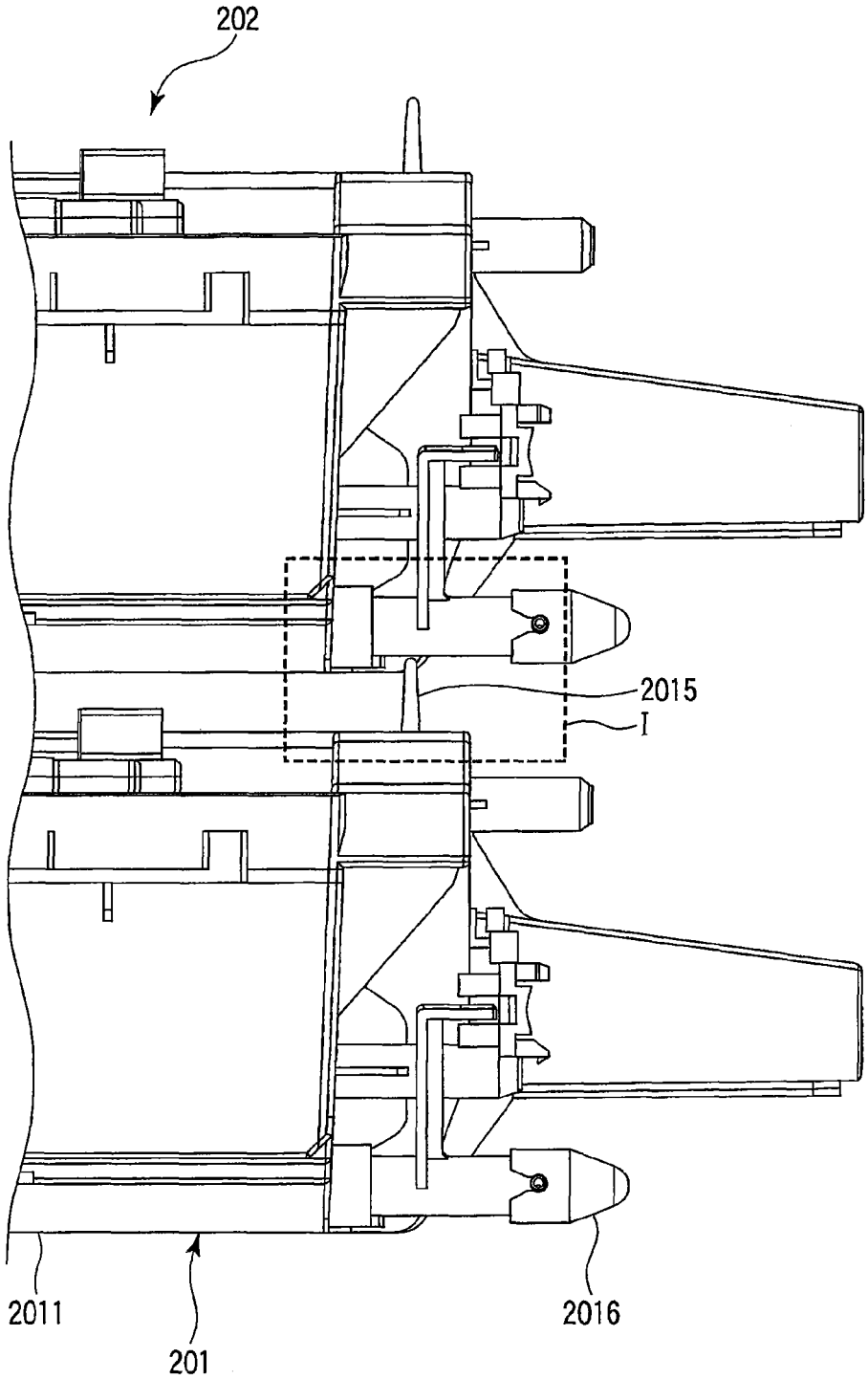
FIG. 4A is an exemplary side view of the sheet cassette of the embodiment.
Figure 4B:
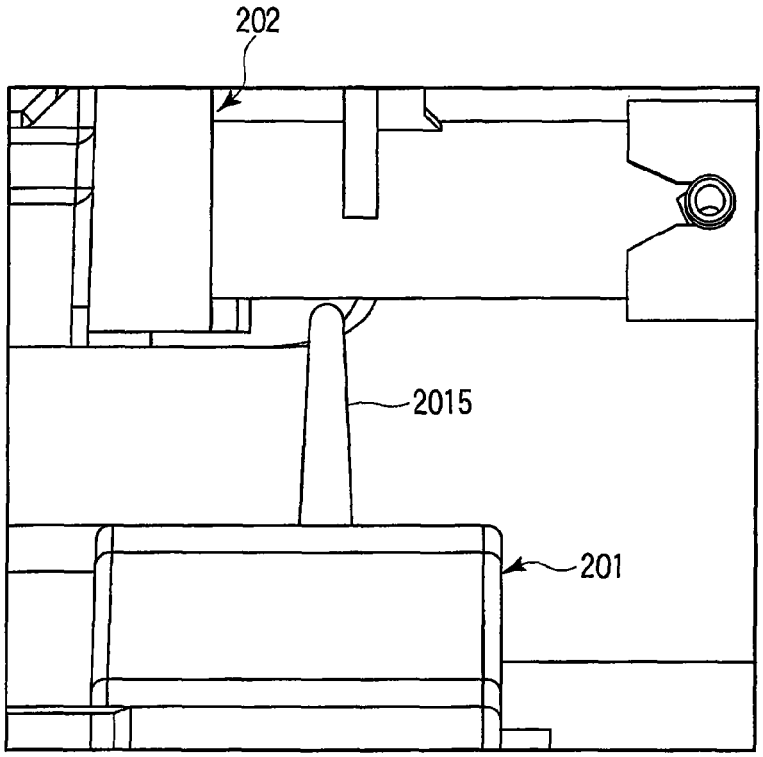
FIG. 4B is an exemplary enlarged side view showing a rear side of the sheet cassette of the embodiment.
Figure 4C:
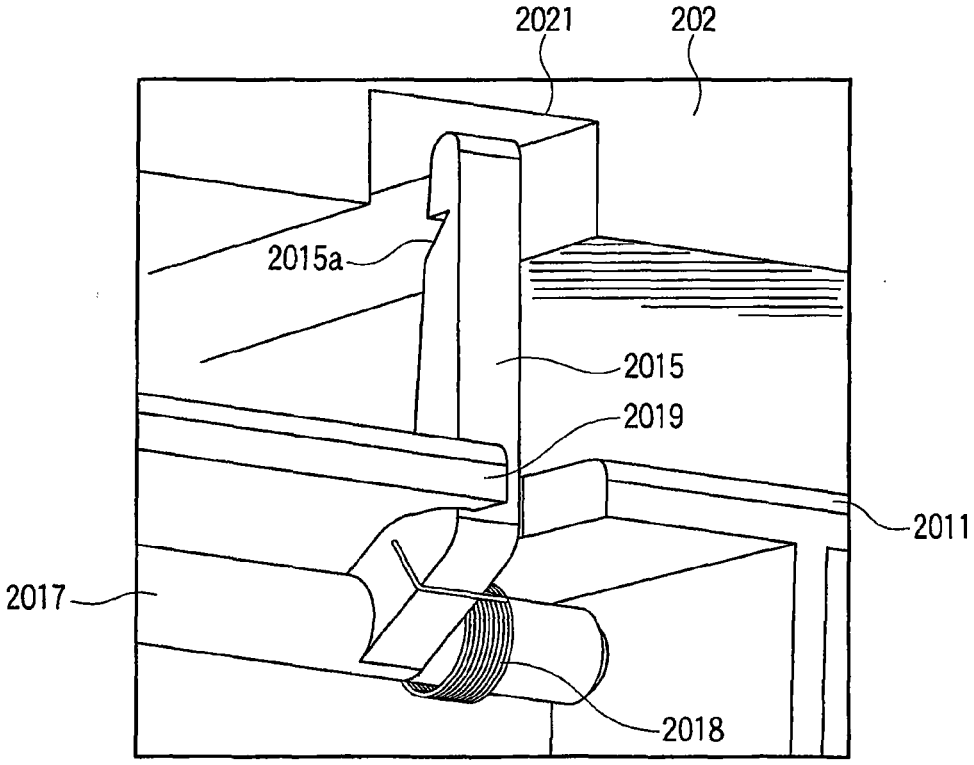
FIG. 4C is an exemplary perspective view of the rear side of the sheet cassette of the embodiment.

FIG. 4A is a side view of the sheet cassette 201 and the sheet cassette 202 inserted in the image forming apparatus 1 of the embodiment. FIG. 4B is an enlarged side view of the sheet cassette 201 and the sheet cassette 202 showing a portion I of FIG. 4A. FIG. 4C is a perspective view of the sheet cassette 201 and the sheet cassette 202 inserted in the image forming apparatus 1 of the embodiment when viewed from the rear side. The sensor 2015 protrudes in the vertical direction from the bottom of the sheet cassette 202 located above the sheet cassette 201. The bottom of the sheet cassette 202 has a groove 2021 which does not contact the sensor 2015 in the X direction in the range in which the sheet cassette 201 moves back and forth in the X direction. Even when the sheet cassette 201 is pulled out from the image forming apparatus 1, the sensor 2015 can avoid contact with the sheet cassette 202 by means of the groove 2021. Incidentally, the shape of the groove 2021 is not limited as long as the sheet cassette 202 does not contact the sensor 2015.

The bottom of the sheet cassette 201 also has a groove similar to the groove 2021 in the X direction so that it does not contact the sensor of the sheet cassette 203 located below the sheet cassette 201. The bottom of the sheet cassette 203 also has a groove similar to the groove 2021 in the X direction so that it does not contact the sensor of the sheet cassette 204 located below the sheet cassette 203. The bottom of the image forming part 10 located above the sheet cassette 202 also has a groove similar to the groove 2021 in the X direction so that it does not contact the sensor of the sheet cassette 202. The bottom of the sheet cassette 204 is not required to have a groove since a member to be pulled out from the image forming apparatus 1 and having a sensor does not exist below the sheet cassette 204. That is, the bottoms of at least the sheet cassettes 201, 202 and 203 and the image forming part 10 have the grooves. Incidentally, when the sheet cassette 204 can be received at an arbitrary position of the sheet conveyance device 20, for example, at the position of one of the sheet cassettes 201, 202 and 203 shown in FIG. 1, it has a groove similar to the groove 2021 in the X direction. This is because in the sheet conveyance device 20, there is a possibility that the sheet cassette 204 is pulled out from the image forming apparatus 1 and is received above a sheet cassette having a sensor.

Figure 5A:
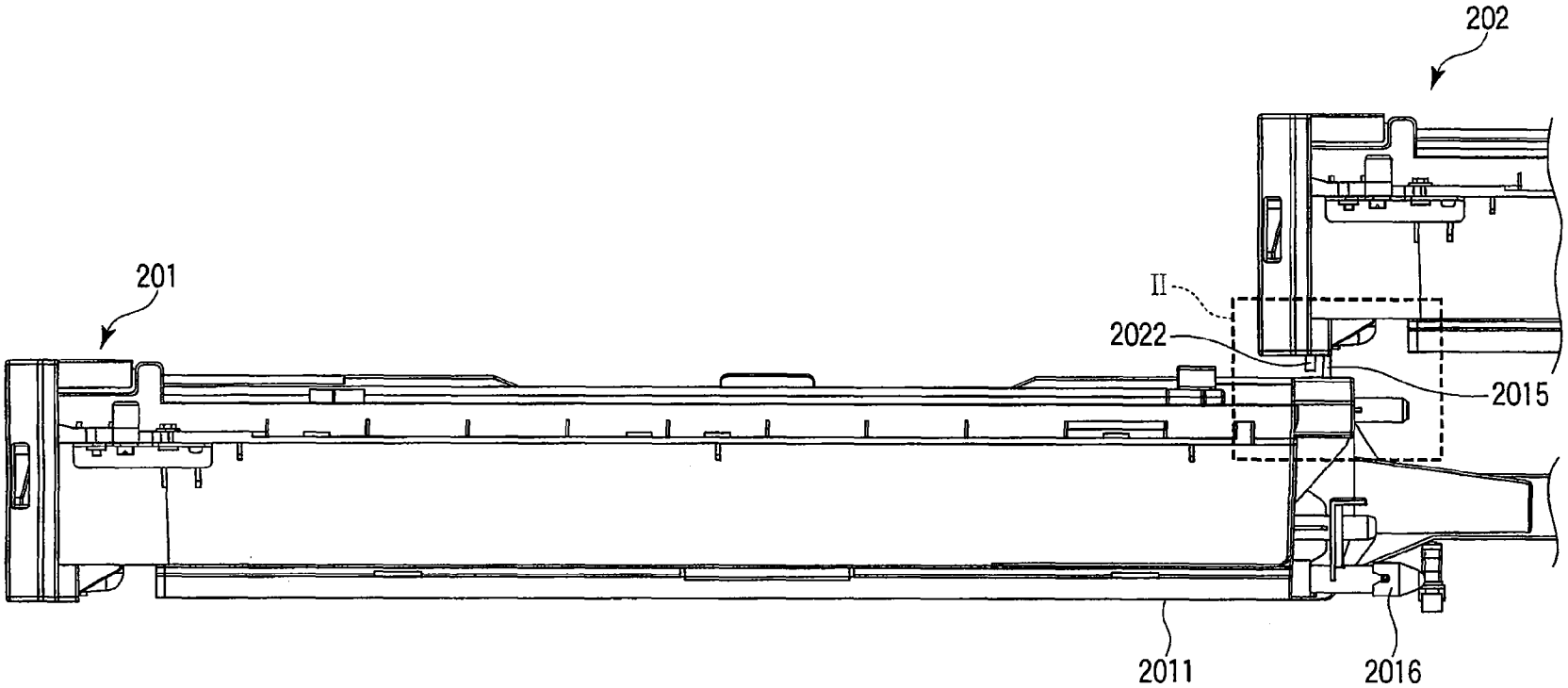
FIG. 5A is an exemplary side view of the sheet cassette of the embodiment.
Figure 5B:
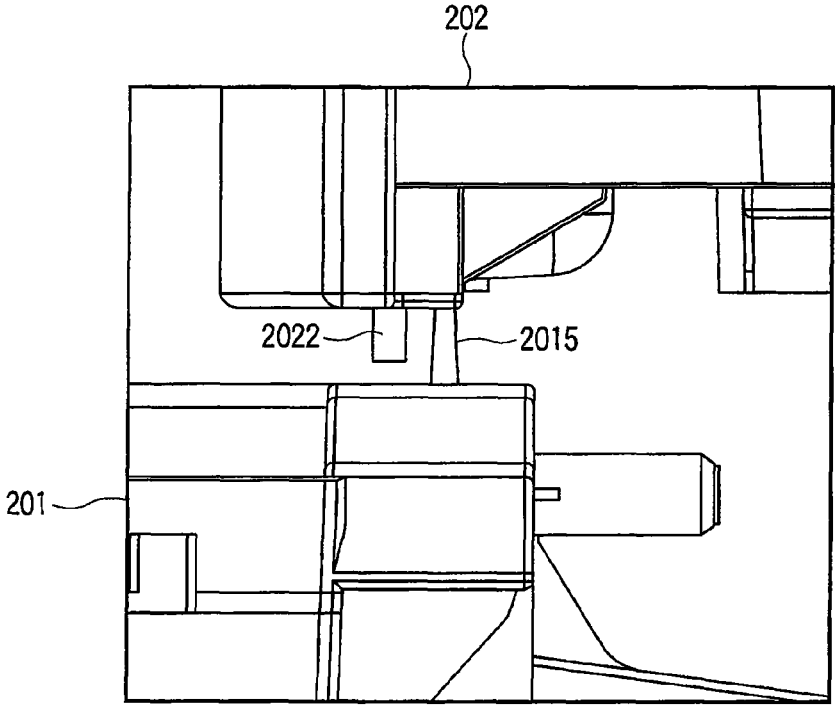
FIG. 5B is an exemplary enlarged side view showing the rear side of the sheet cassette of the embodiment.

FIG. 5A is a side view showing a state where the sheet cassette 201 is pulled out from the image forming apparatus 1 of the embodiment. FIG. 5B is an enlarged side view of the sheet cassette 201 and the sheet cassette 202 showing a portion II in FIG. 5A. The sheet cassette 202 includes a cover member 2022 extending downward in the vertical direction from the bottom to the sheet cassette 201 side at the front side. As an example, the cover member 2022 protrudes in the vertical direction from the wall surface of the sheet cassette 202 at the front side. The cover member 2022 protrudes in the vertical direction to a position where it does not contact any portion of the sheet cassette 201 in the range in which the sheet cassette 201 moves back and forth in the X direction. The cover member 2022 faces the sensor 2015 in the horizontal direction. The size of the cover member 2022 in the Y direction is larger than the size of the sensor 2015 in the Y direction. That is, even when the sheet cassette 201 is pulled out in the pull-out direction from the image forming apparatus 1 to the utmost, the user can not touch the sensor 2015.

The bottom of the sheet cassette 201 also has a cover member similar to the cover member 2022 at the front side so that it faces the sensor of the sheet cassette 203 located below the sheet cassette 201. The bottom of the sheet cassette 203 also has a cover member similar to the cover member 2022 at the front side so that it faces the sensor of the sheet cassette 204 located below the sheet cassette 203. The bottom of the image forming part 10 located above the sheet cassette 202 also has a cover member similar to the cover member 2022 at the front side so that it faces the sensor of the sheet cassette 202. The bottom of the sheet cassette 204 is not required to have a cover member at the front side since there is no member which is located below the sheet cassette 204, is pulled out from the image forming apparatus 1 and has a sensor. That is, the bottoms of at least the sheet cassettes 201, 202 and 203 and the image forming part 10 have the cover members at the front side. Incidentally, when the sheet cassette 204 can be received at an arbitrary position of the sheet conveyance device 20, for example, at a position of one of the sheet cassettes 201, 202 and 203 shown in FIG. 1, the bottom has a cover member similar to the cover member 2022 at the front side. This is because in the sheet conveyance device 20, there is a possibility that the sheet cassette 204 is received above another sheet cassette which is pulled out from the image forming apparatus 1 and has a sensor. According to this embodiment, the cover member 2022 can prevent the sensor 2015 from detecting contact other than contact of a sheet.

Next, a description will be made on various modes concerning the structure of the sensor 2015 and the connection between the sensor 2015 and the housing 2011. As shown in FIG. 4C, the sensor 2015 is coupled to a shaft 2017, which is parallel to the Y direction and is provided to the wall surface of the housing 2011 at the rear side, through an α spring 2018. One end of the sensor 2015 in the X direction contacts the wall surface of the housing 2011 at the rear side, and the other end is opened. The α spring 2018 exerts a force to press the sensor 2015 to the housing 2011. When a force higher than the force of the α spring 2018 is applied to the tip of the sensor 2015 in the X direction, the sensor rotates around the shaft 2017 in an arrow Z direction shown in FIG. 3. The α spring 2018 prevents the sensor 2015 from erroneously detecting the sheet displacement by the shock of insertion or pulling-out of the sheet cassette 201. Incidentally, instead of the α spring 2018, another elastic body having the same function may be used.

Further, as shown in FIG. 4C, the housing 2011 includes a regulating member 2019. The regulating member 2019 contacts the sensor 2015 when the sensor is pressed by the sheet in the X direction and is rotated by a specific angle. The regulating member 2019 prevents the sensor 2015 from rotating by an angle higher than the specific angle. Accordingly, the sensor 2015 prevents the sheet remaining by the regulating member 2019, and the sheet subjected to the sheet displacement, together with the sheet cassette 201, can be efficiently pulled out from the inside of the image forming apparatus 1.

Further, the sensor 2015 has a notch 2015*a*. The notch 2015*a* is located in the vicinity of the tip of the surface of the sensor 2015, which contacts a sheet. The notch 2015*a* is dented in the X direction from the surface of the sensor 2015, which contacts the sheet, in the state where the sensor 2015 protrudes in the vertical direction. The notch 2015*a* is provided in the Y direction on the surface of the sensor 2015, which contacts the sheet. The notch 2015*a* catches the sheet before the sheet climbs over the sensor 2015 in the X direction. Incidentally, the notch 2015*a* has only to be capable of catching the sheet, and its shape is not limited. A recess or a concave part may be adopted. Even if the sheet cassette 201 is pulled out from the image forming apparatus 1 in the state where the sheet displacement occurs, the sheet subjected to the sheet displacement, together with the sheet cassette 201, is pulled out from the inside of the image forming apparatus 1 in the state where it is caught by the notch 2015*a*.

The surface of the sensor 2015, which contacts the sheet, is orthogonal to the X direction in the state where the sensor protrudes in the vertical direction. As the surface of the sensor 2015, which contacts the sheet, becomes large, the function as a stopper to the sheet becomes effective. Although FIG. 2 shows an example where the sheet cassette 201 includes only one sensor 2015, the number of the sensors 2015 is not limited to this. The plural sensors 2015 may be provided on the wall surface of the housing 2011 at the rear side in the Y direction. Incidentally, when the sheet cassette 201 includes the plural sensors 2015, the sheet cassette 202 located above the sheet cassette 201 has the plural grooves 2021 to release the plural sensors 2015.

Figure 6:
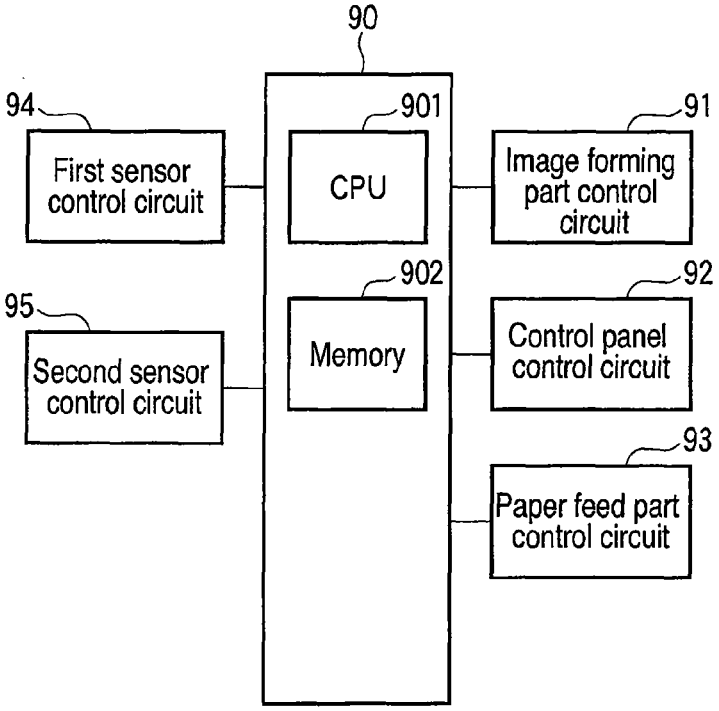
FIG. 6 is an exemplary block diagram showing a control system of the image forming apparatus of the embodiment.

FIG. 6 is a block diagram showing a control system of the image forming apparatus 1 of the embodiment. The image forming apparatus 1 includes a main controller 90, an image forming part control circuit 91, a control panel control circuit 92, a paper feed part control circuit 93, a first sensor control circuit 94, and a second sensor control circuit 95. The main controller 90 includes a CPU 901 and a memory 902. The CPU 901 controls the respective parts based on a control program stored in the memory 902. The image forming part control circuit 91 controls the image forming operation of the image forming part 10 by instructions of the CPU 901. The control panel control circuit 92 controls the display of a message on the control panel 40 and the reception of the user's input by the instructions of the CPU 901. The paper feed part control circuit 93 controls the conveyance of the sheet by the paper feed roller 21 by the instructions of the CPU 901. Further, the paper feed part control circuit 93 controls the driving of the drive unit 22 by the instructions of the CPU 901. The second sensor control circuit 94 controls the operation of the sensor 2015 by the instructions of the CPU 901. While something contacts (while the ON state occurs), the sensor 2015 outputs a signal to the sensor control circuit 94 (signal is on). While nothing contacts (while the OFF state occurs), the sensor 2015 does not output a signal to the sensor control circuit 94 (signal is off). The second sensor control circuit 95 controls the operation of a not-shown open and close sensor. The open and close sensor is located in the image forming apparatus 1. The open and close sensor detects whether the sheet cassette 201 is completely inserted in the image forming apparatus 1.

In this embodiment, the CPU 901 always monitors whether the signal from the sensor 2015 is on or off. When detecting the signal from the sensor 2015 (in other words, the sensor 2015 detects the contact of a sheet), the CPU 901 controls the control panel 40 to display an attention message indicating that there is a possibility that the sheet displacement occurs. The control panel 40 functions as an alarm of the attention message. Incidentally, the CPU 901 may control so that the attention message or a warning sound is outputted as sound from the control panel 40. The CPU 901 may control to turn on a lamp of the control panel 40. The CPU 901 may control the control panel 40 so that the display of the attention message, the sound output, and the turning-on of the lamp are executed in an arbitrary combination simultaneously or in sequence. Incidentally, after the sensor 2015 is placed in the off state and the open and close sensor detects that the sheet cassette 201 is completely inserted in the image forming apparatus 1, the CPU 901 controls to resume the conveyance of a sheet by the paper feed roller 21.

According to this embodiment, when the sheet cassette 201 is pulled out from the image forming apparatus 1, the sheet displacement can be detected, and the sheet remaining can be prevented. The user confirms the attention message displayed on the control panel 40, and can early recognize the possibility of the occurrence of the sheet remaining. As a result, the user removes the sheet subjected to the sheet displacement, and can prevent a defect from occurring in the image forming apparatus 1.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a cassette configured to stack a sheet;

a sensor provided at a rear end of the cassette and configured to have a notch to catch the sheet protruding from the cassette; and a controller configured to, when the sensor detects protrusion of the sheet from the cassette, control an alarm to notify that the sheet protrudes from the cassette.

2. The apparatus of claim 1, wherein the sensor is provided on a wall surface of the cassette.

3. The apparatus of claim 2, wherein the sensor is provided in a vertical direction.

4. The apparatus of claim 3, wherein the sensor is rod-shaped.

5. The apparatus of claim 4, wherein the sensor protrudes in a vertical direction towards a bottom of another cassette located above the cassette.

6. The apparatus of claim 5, wherein the another cassette includes a groove that does not contact the sensor in a pull-out direction of the cassette.

7. The apparatus of claim 6, wherein the another cassette includes a cover member that is located at a front side of the image forming apparatus and faces the sensor.

8. The apparatus of claim 7, wherein the cover member does not contact the cassette in the pull-out direction.

9. The apparatus of claim 5, wherein more than two cassettes are provided, and each of the cassettes includes a groove that extends in a pull-out direction of the cassette.

10. The apparatus of claim 1, wherein the sensor is an actuator.

11. The apparatus of claim 1, further comprising a shaft member configured to couple the cassette and the sensor.

12. The apparatus of claim 11, wherein a front side of the sensor in a pull-out direction of the cassette contacts the cassette.

13. The apparatus of claim 12, wherein the sensor rotates around the shaft member.

14. The apparatus of claim 13, wherein the cassette includes a regulating member to prevent the sensor from rotating by a specific angle or more.

15. The apparatus of claim 13, wherein the sensor is coupled to the cassette by a spring.

16. The apparatus of claim 15, wherein the spring is an a spring.

17. The apparatus of claim 15, wherein the spring presses the sensor to the cassette.

18. The apparatus of claim 1, further comprising a roller configured to convey the sheet in a direction orthogonal to a pull-out direction of the cassette.

19. The apparatus of claim 18, wherein the sensor is provided in a vicinity of the roller.

20. A paper feeding apparatus comprising:

a cassette configured to stack a sheet;

a sensor provided at a rear end of the cassette and configured to have a notch to catch the sheet protruding from the cassette; and a controller configured to, when the sensor detects protrusion of the sheet from the cassette, control an alarm to notify that the sheet protrudes from the cassette.

* * * * *